US009817415B2

(12) United States Patent
Peluso et al.

(10) Patent No.: US 9,817,415 B2
(45) Date of Patent: Nov. 14, 2017

(54) WIDE VOLTAGE RANGE LOW DROP-OUT REGULATORS

(71) Applicant: QUALCOMM Incorporated, San Diego, CA (US)

(72) Inventors: Vincenzo F. Peluso, San Diego, CA (US); Liangguo Shen, San Diego, CA (US); Hua Guan, San Diego, CA (US); Mengmeng Du, San Diego, CA (US); Ngai Yeung Ho, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 88 days.

(21) Appl. No.: 14/800,375

(22) Filed: Jul. 15, 2015

(65) Prior Publication Data

US 2017/0017250 A1 Jan. 19, 2017

(51) Int. Cl.
*G05F 1/575* (2006.01)
*G05F 1/565* (2006.01)

(52) U.S. Cl.
CPC ..... *G05F 1/575* (2013.01); *G05F 1/565* (2013.01)

(58) Field of Classification Search
CPC . G05F 1/46; G05F 1/461; G05F 1/565; G05F 1/468; G05F 1/575
See application file for complete search history.

(56) References Cited

U.S. PATENT DOCUMENTS 6,208,123 B1 * 3/2001 Sudo ..... G05F 1/565 323/280
6,452,766 B1 * 9/2002 Carper ..... G05F 1/573 323/277
6,765,374 B1 * 7/2004 Yang ..... G05F 1/575 323/280
7,362,080 B2 * 4/2008 Sohn ..... G05F 1/573 323/277

(Continued)

FOREIGN PATENT DOCUMENTS

EP 1361664 A1 11/2003
EP 1378991 A1 1/2004

OTHER PUBLICATIONS

Chung-Hsun H., et al., "Design of a Low-Voltage Low-Dropout Regulator," IEEE Transactions on Very Large Scale Integration (VLSI) Systems, IEEE Service Center, Piscataway, NJ, USA, Jun. 1, 2014 (Jun. 1, 2014),vol. 22(6), pp. 1308-1313 XP011548960, ISSN: 1063-8210, DOI: 10.1109/TVLSI.2013.2265499 [retrieved on May 21, 2014].

(Continued)

*Primary Examiner* — Kyle J Moody
(74) *Attorney, Agent, or Firm* — Haynes and Boone, LLP

(57) ABSTRACT

A low drop-out regulator circuit comprises a pass transistor providing an output voltage on an output terminal in response to a gate voltage on a gate of the pass transistor. A feedback circuit is coupled to the output terminal to generate a feedback voltage, and an error amplifier provides a drive signal in response to a reference voltage and the feedback (Continued)

voltage. A first gate driver circuit is operable over a first voltage range to provide the gate voltage to the pass transistor in response to the drive signal. A second gate driver circuit is operable over a second voltage range to provide the gate voltage to the pass transistor in response to the drive signal, where the second voltage range is lower than the first voltage range.

19 Claims, 5 Drawing Sheets

(56) References Cited

U.S. PATENT DOCUMENTS

| | | | | |
|---|---|---|---|---|
| 7,746,046 | B2 * | 6/2010 | Chen | G05F 1/56 323/266 |
| 8,169,204 | B2 * | 5/2012 | Jian | G05F 1/573 323/273 |
| 8,878,510 | B2 | 11/2014 | Bhattacharyya et al. | |
| 9,110,487 | B2 * | 8/2015 | Sakaguchi | G05F 1/573 |
| 9,312,824 | B2 * | 4/2016 | Kuttner | H03F 3/45071 |
| 2003/0178976 | A1 | 9/2003 | Xi | |
| 2008/0224675 | A1 * | 9/2008 | Takagi | G05F 1/565 323/275 |
| 2009/0309562 | A1 * | 12/2009 | Lipcsei | G05F 1/56 323/282 |
| 2013/0265020 | A1 | 10/2013 | Krenzke | |
| 2014/0247087 | A1 | 9/2014 | Bhattad et al. | |
| 2014/0266106 | A1 | 9/2014 | El-Nozahi et al. | |
| 2015/0137781 | A1 * | 5/2015 | Qu | G05F 1/56 323/280 |
| 2015/0198960 | A1 * | 7/2015 | Zhang | G05F 1/56 323/280 |
| 2015/0355653 | A1 * | 12/2015 | Drebinger | G05F 1/575 323/280 |
| 2016/0147239 | A1 * | 5/2016 | Yan | G05F 1/575 323/280 |

OTHER PUBLICATIONS

International Search Report—PCT/US2016/037267—ISA/EPO—Nov. 2, 2016.

Written Opinion—PCT/US2016/037267—ISA/EPO—Nov. 2, 2016.

Peng G-Y., et al., "A High Current Efficiency Rail-to-Rail Buffer for Low Drop-out Regulators With Load Regulation-Enhanced", International Symposium on VLSI Design, Automation and Test (VLSI-DAT), 2011, 4 pages.

* cited by examiner

100

500

WIDE VOLTAGE RANGE LOW DROP-OUT REGULATORS

BACKGROUND

The disclosure relates to electronic circuits, and in particular, to wide voltage range low drop-out regulators.

Unless otherwise indicated herein, the approaches described in this section are not admitted to be prior art by inclusion in this section.

An NMOS low drop out (LDO) regulator has a desired output voltage, Vset, that is programmable. However, for some desired output voltages the actual output voltage, Vout, of the LDO may float upwards and the LDO loses regulation, if there is no load or a light load on the output of the LDO. A lower desired output voltage Vset is normally used in a sleep mode, during which the quiescent current of the LDO may be important to preserve battery life. The upwards floating of the output voltage Vout can cause large leakage current or overstress in the load.

SUMMARY

The present disclosure includes techniques pertaining to wide voltage range low drop-out regulators. In one embodiment, the present disclosure includes a low drop-out regulator circuit comprising a pass transistor providing an output voltage on an output terminal in response to a gate voltage on a gate of the pass transistor, a feedback circuit coupled to the output terminal to generate a feedback voltage, an error amplifier including an output to provide a drive signal in response to a reference voltage and the feedback voltage, a first gate driver circuit operable over a first voltage range to provide the gate voltage to the pass transistor in response to the drive signal, and a second gate driver circuit operable over a second voltage range to provide the gate voltage to the pass transistor in response to the drive signal, wherein the second voltage range is lower than the first voltage range.

In one embodiment, the first gate driver circuit includes a source follower and a current feedback buffer, and the second gate driver circuit is a differential pair buffer.

In one embodiment, the current feedback buffer comprises a field-effect transistor having a gate coupled to a source of the source follower, the current feedback buffer comprises a bipolar junction transistor having a base coupled to a drain of the field-effect transistor and a collector coupled to a node formed of the gate of the pass transistor and a source of the field-effect transistor.

In one embodiment, the source follower comprises a first field-effect transistor and the current feedback buffer comprises a second field-effect transistor having a gate coupled to a source of the first field-effect transistor and having a source coupled to the gate of the pass transistor.

In one embodiment, the current feedback buffer comprises a bipolar junction transistor having a base coupled to a drain of the second field-effect transistor and a collector coupled to the gate of the pass transistor, the current feedback buffer comprises a current source coupled between the base of the bipolar junction transistor and an emitter of the bipolar junction transistor.

In one embodiment, the differential pair buffer comprises a first transistor having a gate, a source, and a drain, wherein the gate of the first transistor is configured to receive the drive signal, and a second transistor having a gate, a source, and a drain, wherein the drain of the second transistor is coupled to the gate of the pass transistor.

In one embodiment, the circuit further comprising a bias current source coupled to the source of the first transistor and the source of the second transistor, a third transistor having a drain coupled to the drain of the first transistor, and a fourth transistor having a drain coupled to the drain of the second transistor.

In one embodiment, the first gate driver circuit includes a first current feedback buffer, and the second gate driver circuit includes a second current feedback buffer coupled in parallel to the first current feedback buffer.

In one embodiment, the first current feedback buffer and the second current feedback buffer have equivalent output impedance.

In one embodiment, the first gate driver circuit comprises a first field-effect transistor having a gate to receive the drive voltage, wherein the first current feedback buffer comprises a second field-effect transistor, a first current source, a second current source, and a bipolar junction transistor, wherein the second field-effect transistor has a gate coupled to a source of the first field-effect transistor, wherein the first current source is coupled to a node formed of a source of the second field-effect transistor and the gate of the pass transistor, wherein the bipolar junction transistor has a base coupled to a drain of the second field-effect transistor and a collector coupled to the gate of the pass transistor, and wherein the second current source is coupled between the base of the bipolar junction transistor and an emitter of the bipolar junction transistor.

In one embodiment, the second current feedback buffer comprises a bias current source, a first input leg including a third field-effect transistor and a current sink, and a second input leg including a fourth field-effect transistor and an auxiliary buffer transistor.

In one embodiment, the first gate driver circuit comprises a first field-effect transistor having a gate to receive the drive voltage, wherein the first current feedback buffer comprises a second field-effect transistor, a first current source, a second current source, and a bipolar junction transistor, wherein the second field-effect transistor has a gate coupled to a source of the first field-effect transistor, wherein the first current source is coupled to a node formed of the source of the second field-effect transistor and the gate of the pass transistor, wherein the first bipolar junction transistor has a base coupled to a drain of the second field-effect transistor and a collector coupled to the gate of the pass transistor, wherein the second current source is coupled between the base of the first bipolar junction transistor and an emitter of the first bipolar junction transistor. The second current feedback buffer comprises a bias current source, a third field-effect transistor, a current sink, a fourth field-effect transistor, and an auxiliary buffer transistor. The third field-effect transistor has a source coupled to the bias current source, has a drain coupled to a first terminal of the current sink, and has a gate coupled to the output of the error amplifier, the fourth field-effect transistor has a drain coupled to the bias current source, has a source coupled to the gate of the pass transistor, and has a gate coupled to the drain of the fourth field-effect transistor, and the auxiliary buffer transistor has a control terminal coupled to the drain of the third field-effect transistor, has a first terminal coupled to the source of the fourth field-effect transistor, and has a second terminal coupled to a second terminal of the current sink.

In one embodiment, the circuit further comprises a current steering circuit to provide bias current to the first gate driver circuit when the output voltage is in the first voltage range and to provide bias current to the second gate driver circuit when the output voltage is in the second voltage range.

In one embodiment, the current steering circuit provides bias current to the first gate driver circuit and not the second first gate driver circuit over the first voltage range and the current steering circuit provides bias current to the second gate driver circuit and not the first gate driver circuit over the second voltage range.

In another embodiment, the present disclosure includes a low drop-out regulator comprising means for providing an output voltage in response to a gate voltage, means for generating a feedback voltage in response to the output voltage, means for generating a drive signal in response to the feedback voltage and a reference voltage, first means for providing the gate voltage in response to the drive signal, the first means for providing the gate voltage being operable over a first voltage range, and second means for providing the gate voltage in response to the drive signal, the second means for providing the gate voltage being operable over a second voltage range, wherein the second voltage range is lower than the first voltage range.

In one embodiment, the first means for providing the gate voltage comprises means for feeding back a current to buffer the gate voltage.

In one embodiment, the second means for providing the gate voltage comprises means for receiving the drive signal and the gate voltage and differentially buffering the drive signal to produce the gate voltage.

In one embodiment, the second means for providing the gate voltage comprises means for feeding back a current to buffer the gate voltage.

In another embodiment, the present disclosure includes a method of regulating a voltage across a wide output voltage range. In one embodiment, the method comprises providing an output voltage in response to a gate voltage applied to a gate of a pass transistor, generating a feedback voltage in response to the output voltage, providing the gate voltage from a first gate driver circuit in response to the feedback voltage being in a first voltage range, and providing the gate voltage from a second gate driver circuit in response to the feedback voltage being in a second voltage range, wherein the second voltage range is lower than the first voltage range.

In one embodiment, the method further comprises controlling current to the first gate driver circuit and the second gate driver circuit in response to the feedback voltage.

The following detailed description and accompanying drawings provide a better understanding of the nature and advantages of the present disclosure.

BRIEF DESCRIPTION OF THE DRAWINGS

With respect to the discussion to follow and in particular to the drawings, it is stressed that the particulars shown represent examples for purposes of illustrative discussion, and are presented in the cause of providing a description of principles and conceptual aspects of the present disclosure. In this regard, no attempt is made to show implementation details beyond what is needed for a fundamental understanding of the present disclosure. The discussion to follow, in conjunction with the drawings, make apparent to those of skill in the art how embodiments in accordance with the present disclosure may be practiced. In the accompanying drawings.

DETAILED DESCRIPTION

In the following description, for purposes of explanation, numerous examples and specific details are set forth in order to provide a thorough understanding of the present disclosure. It will be evident, however, to one skilled in the art that the present disclosure as expressed in the claims may include some or all of the features in these examples, alone or in combination with other features described below, and may further include modifications and equivalents of the features and concepts described herein.

Figure 1:
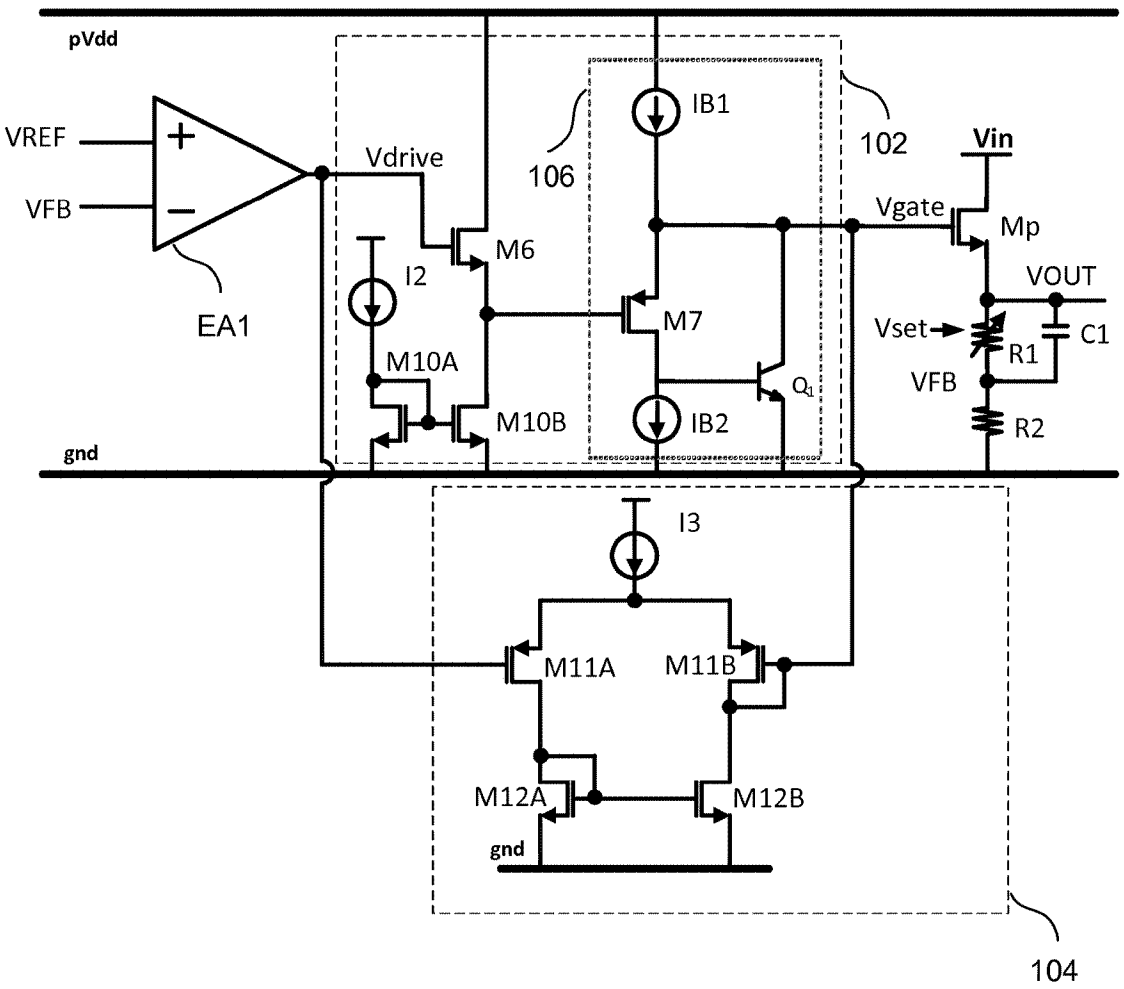
FIG. 1 is a block diagram illustrating a first example of a low drop-out regulator (LDO) according to some embodiments.

FIG. 1 is a block diagram illustrating an LDO 100 according to some embodiments. LDO 100 comprises a pass transistor Mp that generates an output voltage VOUT, a feedback circuit (e.g., a resistor ladder comprising resistor R1 and resistor R2) that provides a feedback voltage VFB based on the output voltage VOUT, a capacitor C1, and an error amplifier EA1 that compares the feedback voltage VFB to a reference voltage Vref to generate a drive voltage Vdrive.

LDO 100 further comprises a first gate driver circuit 102 that includes a source follower (e.g., including transistor M6) and a current feedback buffer 106 that provides a gate voltage Vgate to pass transistor Mp. In this example, current feedback buffer 106 includes a first bias current source IB1, an optional second bias current source IB2, a field-effect transistor M7 and a bipolar junction transistor Q1. Current feedback buffer 106 is one example mechanism for feeding back a current to buffer the gate voltage. In some embodiments, a metal-oxide-semiconductor field-effect transistor (MOSFET) may be used instead of a bipolar junction transistor Q1. The first gate driver 102 further comprises a current sink circuit comprising current source I2 (e.g., 5 uA), a transistor M10A, and a transistor 10B arranged as a current mirror to mirror the current of current source I2 and set the current of source follower M6.

In one embodiment, a second gate driver circuit 104 is an auxiliary buffer 104 that is coupled in parallel to the first gate driver 102 and provides the gate voltage Vgate to pass transistor Mp. As described in detail below, the second gate driver circuit 104 operates across a range of voltages below a range of operating voltages for gate driver circuit 102 to allow the LDO to produce low output voltages Vout. For instance, the first gate driver circuit 102 and second gate driver circuit 104 may work in parallel across different voltage ranges to provide the gate voltage Vgate to the pass transistor Mp. A lower portion of the operable voltage range for gate driver circuit 102 may overlap an upper portion of the operable voltage range for gate driver circuit 104 to produce a desired output voltage Vout across a wide range of output voltages, for example. The first gate driver 102 is operable when the set voltage, Vset (e.g., a programmable voltage applied to adjust the resistance of variable resistor R1 for setting the output voltage Vout), is in a first voltage range. The second gate driver circuit 104 is operable when the set voltage Vset is in a second voltage range that is lower than the first voltage range where the first gate driver 102 becomes inoperable. In one example embodiment, the second gate driver circuit 104 is an auxiliary buffer, which may be a differential input buffer that has unity gain, for example. The auxiliary buffer 104 may also have no voltage level shift. The current feedback buffer 106 in the first gate driver circuit 102 may overpower the auxiliary buffer 104 in the first voltage range such that the current feedback buffer 106 provides most of the drive for the pass transistor Mp. The current feedback buffer 106 may have an output impedance that is 10 or more times lower than the output impedance of the auxiliary buffer 104, for example.

In this example, a source follower transistor M6 drives the gate of transistor M7, which in conjunction with transistor Q1 operates as a buffer to control the gate voltage Vgate of the pass transistor Mp and the output voltage Vout. At lower set voltages, Vset, the output of the error amplifier EA1 decreases to thereby decrease the voltage on the gate of transistor M6, and thereby reduce the voltage on the gate of transistor M7. Because the gate of transistor M7 cannot go lower than ground, the LDO loop is broken and the current feedback buffer 106 shuts down. Accordingly, the gate voltage Vgate of pass transistor Mp and the output voltage Vout are limited at lower output voltages when controlled by only the current feedback buffer 106 formed of the transistor M7 and the transistor Q1.

At lower output voltages, VOUT, an auxiliary buffer may operate to set the gate voltage Vgate of pass transistor Mp because the current feedback buffer 106 has shut down. A second gate driver circuit 104 operable across a lower voltage range, for example, allows LDO 100 to operate at lower output voltage levels than first gate driver 102 may allow by itself.

In one embodiment, an auxiliary buffer comprises a differential input pair formed of transistors M11A and M12A for a first leg and transistors M11B and M12B for a second leg, and a bias current source I3 (e.g., 10 uA). In this example, the auxiliary buffer is a low voltage buffer that operates at lower set voltages than the first gate driver circuit 102. Circuit 104 is one example mechanism for receiving the drive signal and the gate voltage and differentially buffering the drive signal to produce the gate voltage.

At higher set voltages Vset, both driver 102 and driver 104 are active. At lower set voltages Vset, driver 102 shuts off and driver 104 is active to control the gate voltage Vgate for regulating the output voltage Vout. In this example, with driver 102 shut off, current from current source IB1 (e.g., 20 uA or a variable current) flows into the auxiliary buffer.

Figure 2:
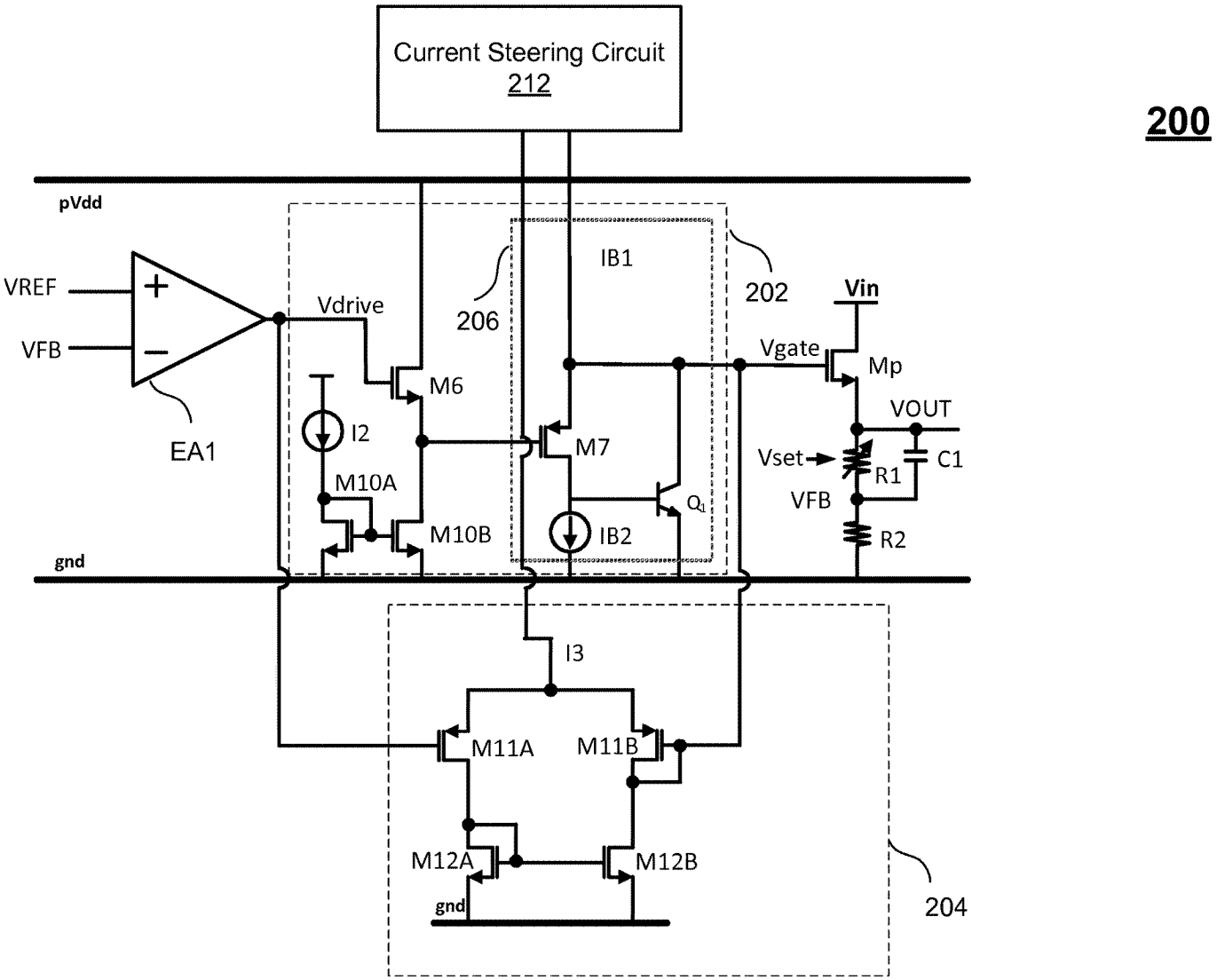
FIG. 2 is a block diagram illustrating a second example of an LDO according to some embodiments.

FIG. 2 is a block diagram illustrating an LDO 200 according to some embodiments. LDO 200 comprises a first gate drive circuit 202 that includes a current feedback buffer 206 that is similar to current feedback buffer 106, but receives a bias current IB1 from a current steering circuit 212. LDO 200 further includes an auxiliary buffer 204 that is similar to auxiliary buffer in FIG. 1, but receives a bias current source I3 from current steering circuit 212. In this example, current steering circuit 212 provides bias current IB1 to transistor M7 and transistor Q1 and a bias current I3 (e.g., 10 uA) to transistors M11A and M11B. The auxiliary buffer 204 is enabled for the lower part of the output voltage range. When the auxiliary buffer 204 is enabled, part of the bias current to transistor M7 and transistor Q1 is redirected to the auxiliary buffer 204. In one example embodiment, the auxiliary buffer 204 may be disabled for the upper part of the output voltage range by turning off the bias current I3 from the current steering circuit 212. Controlling bias current I3 reduces quiescent current of auxiliary buffer 204 for higher set voltages Vset at which current feedback buffer 206 is operable by itself to provide the gate voltage Vgate.

Figure 3:
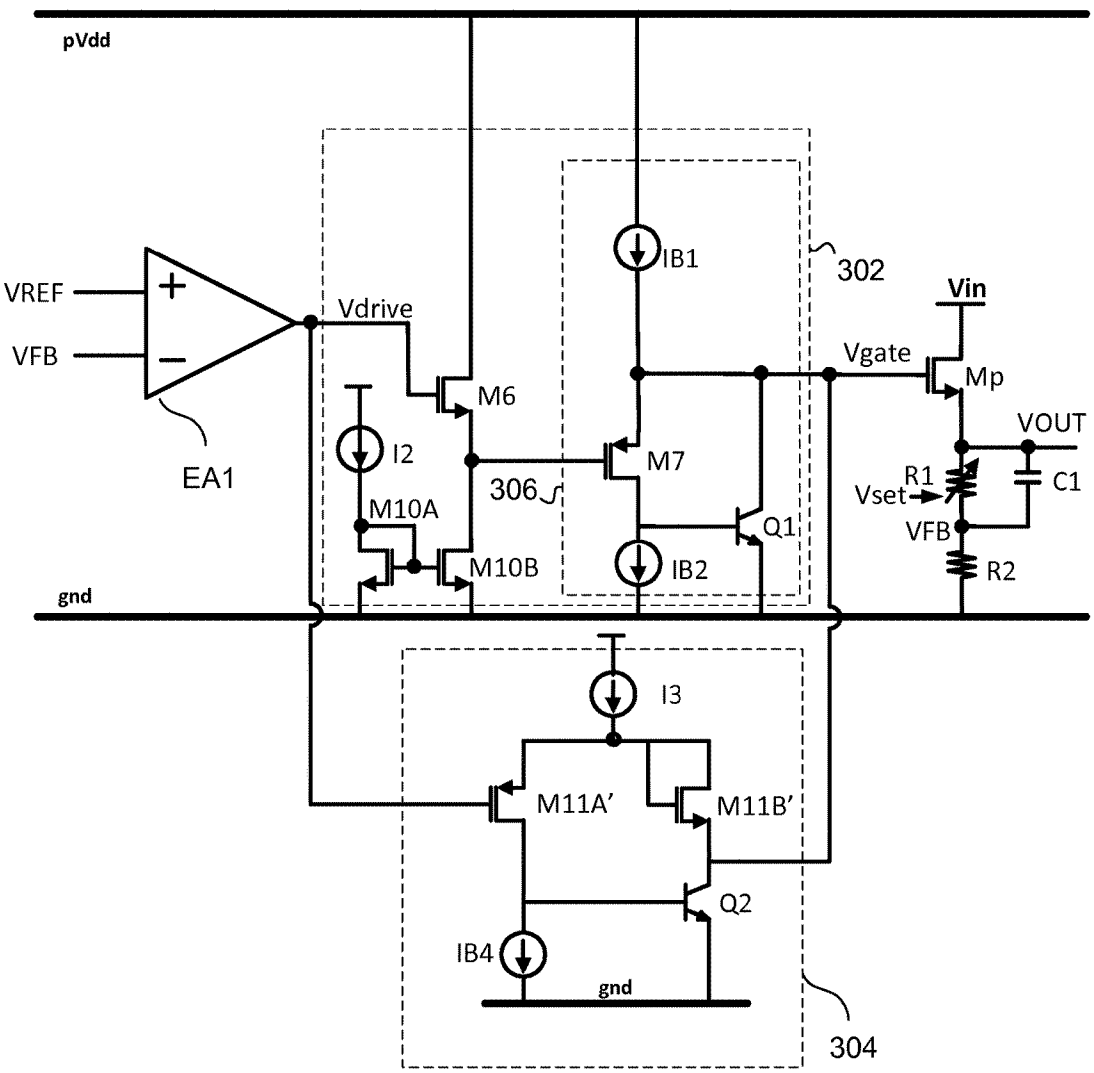
FIG. 3 is a block diagram illustrating a third example of an LDO according to some embodiments.

FIG. 3 is a block diagram illustrating an LDO 300 similar to LDO 100 of FIG. 1. However, in this embodiment an auxiliary buffer 304 comprises transistor M11A' and a current source IB4 for a first leg and a diode connect transistor M11B' and an auxiliary buffer transistor (e.g., bipolar junction transistor Q2) for a second leg, and a bias current source I3. In alternative embodiments, the auxiliary buffer transistor may be a metal oxide field effect transistor ("MOSFET" or just "MOS"). LDO 300 further comprises a first drive circuit 302 that includes a current feedback buffer 306 that is similar to current feedback buffer 106 in FIG. 1.

In this example, gate driver circuit 304 is a current feedback buffer having a similar arrangement as current feedback buffer 306. In some embodiments, transistor M11A' matches transistor M6, and transistor M11B' matches transistor M7. This provides a gate voltage from current feedback buffer 306 to be approximately equal to the gate voltage from gate driver circuit 304. Gate driver circuit 304 is one example mechanism for feeding back a current to buffer the gate voltage. In some example embodiments, gate driver circuit 304 presents an equivalent output impedance to gate driver circuit 306. In some embodiments, current source Ib4 provides half as much current as current source Ib1.

Figure 4:
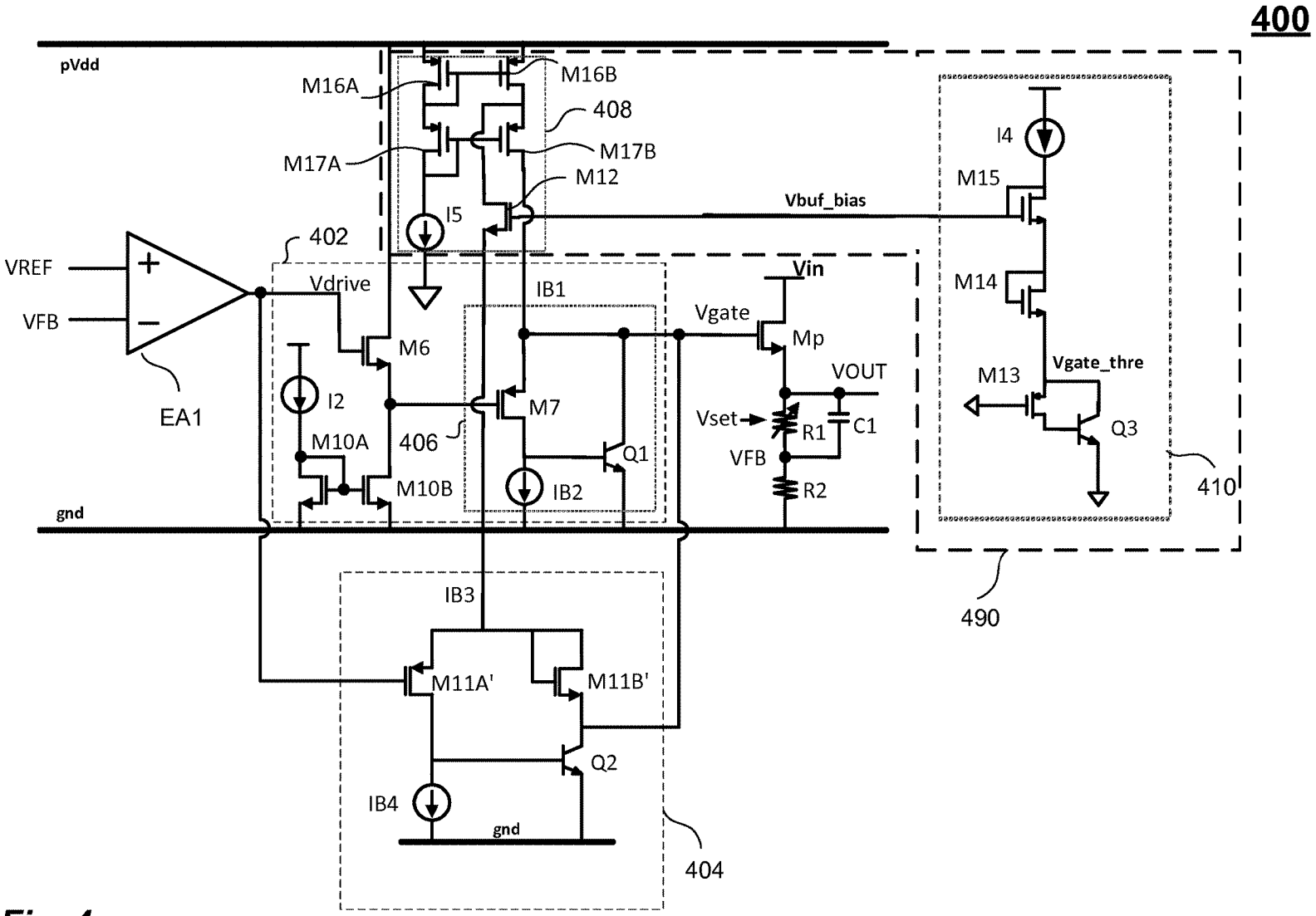
FIG. 4 is a block diagram illustrating a fourth example of an LDO according to some embodiments.

FIG. 4 is a block diagram illustrating an LDO 400 similar to LDO 200 of FIG. 2, but includes an example current steering circuit 406 and an auxiliary buffer 404 that is similar to auxiliary buffer 304 of FIG. 3 with current received from current steering circuit 406 instead of a fixed current source I3. Current steering circuit 406 includes a current source 408 and a buffer bias circuit 410. Current source 408 includes a plurality of cascode transistors M16A and M16B, a current mirror formed of a plurality of transistors M17A and M17B, a current source I5 and a bias transistor M12.

Buffer bias circuit 410 provides a buffer bias voltage (Vbuf_bias) to transistor M12. Buffer bias circuit 410 comprises a current source I4 (e.g., 0.2 uA) and MOS transistors M13, M14, M15, and bipolar transistor Q3.

Current steering circuit 490 operates as follows. For high output voltage Vout, auxiliary buffer 404 receives no bias current because transistor M12 is squeezed off. All the bias current goes into current feedback buffer 406. For low output voltage Vout, the gate voltage Vgate is so low that the loop of current feedback buffer 406 breaks (transistor M7 turns off), and current feedback buffer 406 becomes nonoperational and draws no current. Therefore all the bias current goes to auxiliary buffer 404. In between the two operating ranges, the LDOs described herein may switch between the current feedback buffer and the auxiliary buffer in a range that is a small fraction of each operating range so that there is a gradual but fairly quick transition between the current split from one buffer into the other.

In some embodiments, current steering circuit 490 does not include a buffer bias circuit 410 and current source 408 does not include transistor M12.

Figure 5:
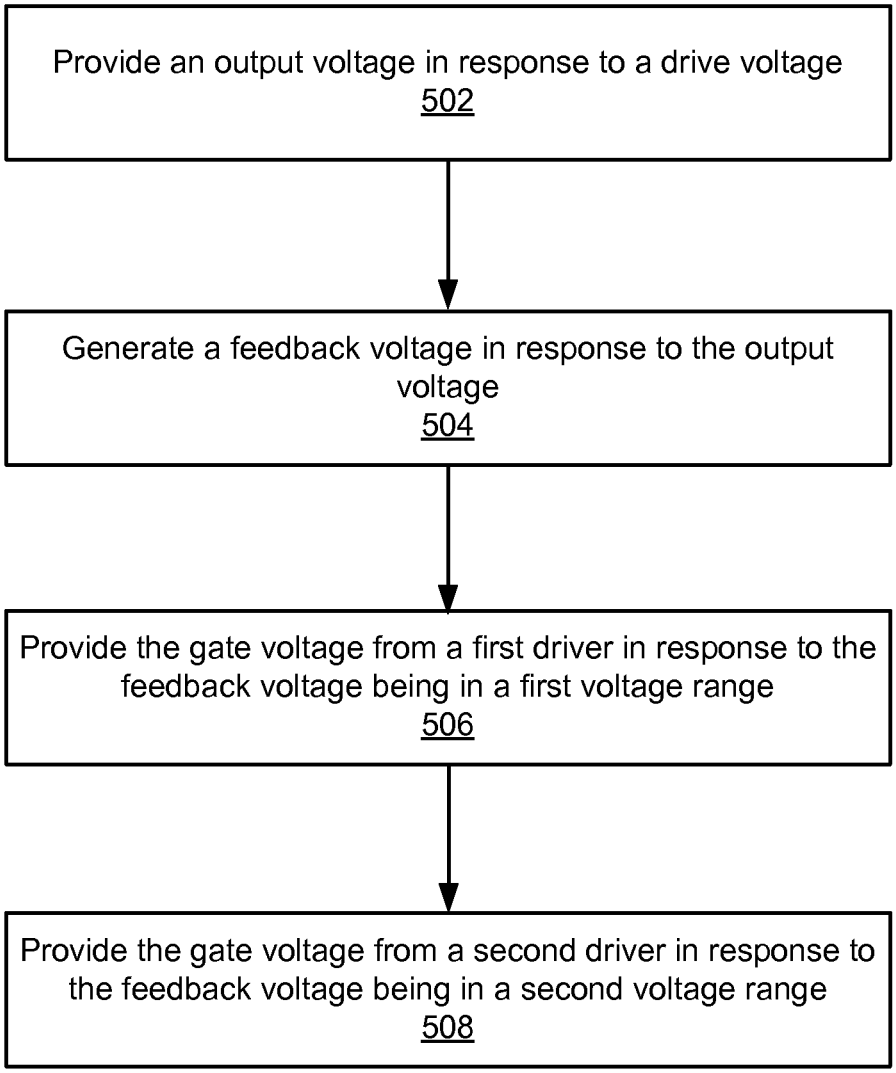
FIG. 5 is a process flow diagram illustrating a method of regulating a voltage across a wide output voltage range according to some embodiments.

FIG. 5 is a process flow diagram illustrating a process flow 500 of an LDO according to some embodiments. Process flow 500 is described for LDO 100, but also may be implemented in a similar manner for the other LDOs described herein.

At 502, an output voltage (e.g., output voltage Vout) is provided (e.g., by pass transistor Mp) in response to a gate voltage (e.g., gate voltage Vgate). At 504, a feedback voltage is generated (e.g., by feedback ladder formed of resistors R1 and R2) in response to the output voltage. At 506, the gate voltage is provided from a first driver (e.g., by driver 102) in response to the feedback voltage being in a first voltage range. At 508, the gate voltage is provided from a second driver (e.g., auxiliary buffer 104) in response to the feedback voltage being in a second voltage range. The second voltage range is lower than the first voltage range.

In one embodiment, the method further comprises generating a drive error voltage (e.g., Vdrive by error amplifier EA1) in response to the feedback voltage. Providing the drive error voltage includes generating the drive error voltage in response to the difference between the feedback voltage and a reference voltage.

The above description illustrates various embodiments of the present disclosure along with examples of how aspects of the particular embodiments may be implemented. The above examples should not be deemed to be the only embodiments, and are presented to illustrate the flexibility and advantages of the particular embodiments as defined by the following claims. Based on the above disclosure and the following claims, other arrangements, embodiments, implementations and equivalents may be employed without departing from the scope of the present disclosure as defined by the claims.

What is claimed is:

1. A low drop-out regulator comprising:

a pass transistor providing an output voltage on an output terminal in response to a gate voltage on a gate of the pass transistor;

a feedback circuit coupled to the output terminal to generate a feedback voltage;

an error amplifier including an output to provide a drive signal in response to a reference voltage and the feedback voltage;

a first gate driver circuit operable over a first voltage range to provide the gate voltage to the pass transistor in response to the drive signal;

a second gate driver circuit operable over a second voltage range to provide the gate voltage to the pass transistor in response to the drive signal, wherein each voltage level in the second voltage range is lower than each voltage level in the first voltage range; and a current steering circuit to provide bias current to the first gate driver circuit when the output voltage is in the first voltage range and to provide bias current to the second gate driver circuit when the output voltage is in the second voltage range.

2. The low drop-out regulator of claim 1 wherein the current steering circuit provides bias current to the first gate driver circuit and not the second gate driver circuit over the first voltage range and the current steering circuit provides bias current to the second gate driver circuit and not the first gate driver circuit over the second voltage range.

3. A low drop-out regulator comprising:

a pass transistor providing an output voltage on an output terminal in response to a gate voltage on a gate of the pass transistor;

a feedback circuit coupled to the output terminal to generate a feedback voltage;

an error amplifier including an output to provide a drive signal in response to a reference voltage and the feedback voltage;

a first gate driver circuit operable over a first voltage range to provide the gate voltage to the pass transistor in response to the drive signal; and a second gate driver circuit operable over a second voltage range to provide the gate voltage to the pass transistor in response to the drive signal, wherein each voltage level in the second voltage range is lower than each voltage level in the first voltage range, wherein the first gate driver circuit includes a source follower and a current feedback buffer, and the second gate driver circuit is a differential pair buffer.

4. The low drop-out regulator of claim 3 wherein the current feedback buffer comprises a field-effect transistor having a gate coupled to a source of the source follower, the current feedback buffer comprises a bipolar junction transistor having a base coupled to a drain of the field-effect transistor and a collector coupled to a node formed of the gate of the pass transistor and a source of the field-effect transistor.

5. The low drop-out regulator of claim 3 wherein the source follower comprises a first field-effect transistor and the current feedback buffer comprises a second field-effect transistor having a gate coupled to a source of the first field-effect transistor and having a source coupled to the gate of the pass transistor.

6. The low drop-out regulator of claim 5 wherein the current feedback buffer comprises a bipolar junction transistor having a base coupled to a drain of the second field-effect transistor and a collector coupled to the gate of the pass transistor, the current feedback buffer comprises a current source coupled between the base of the bipolar junction transistor and an emitter of the bipolar junction transistor.

7. The low drop-out regulator of claim 3 wherein the differential pair buffer comprises:

a first transistor having a gate, a source, and a drain, wherein the gate of the first transistor is configured to receive the drive signal; and a second transistor having a gate, a source, and a drain, wherein the drain of the second transistor is coupled to the gate of the pass transistor.

8. The low drop-out regulator of claim 7 further comprising:

a bias current source coupled to the source of the first transistor and the source of the second transistor;

a third transistor having a drain coupled to the drain of the first transistor; and a fourth transistor having a drain coupled to the drain of the second transistor.

9. A low drop-out regulator comprising:

a pass transistor providing an output voltage on an output terminal in response to a gate voltage on a gate of the pass transistor;

a feedback circuit coupled to the output terminal to generate a feedback voltage;

an error amplifier including an output to provide a drive signal in response to a reference voltage and the feedback voltage;

a first gate driver circuit operable over a first voltage range to provide the gate voltage to the pass transistor in response to the drive signal; and a second gate driver circuit operable over a second voltage range to provide the gate voltage to the pass transistor in response to the drive signal, wherein each voltage level in the second voltage range is lower than each voltage level in the first voltage range, wherein the first gate driver circuit includes a first current feedback buffer, and the second gate driver circuit includes a second current feedback buffer coupled in parallel to the first current feedback buffer.

10. The low drop-out regulator of claim 9 wherein the first current feedback buffer and the second current feedback buffer have equivalent output impedance.

11. The low drop-out regulator of claim 9 wherein the first gate driver circuit comprises a first field-effect transistor having a gate to receive the drive signal, wherein the first current feedback buffer comprises a second field-effect transistor, a first current source, a second current source, and a bipolar junction transistor, wherein the second field-effect transistor has a gate coupled to a source of the first field-effect transistor, wherein the first current source is coupled to a node formed of a source of the second field-effect transistor and the gate of the pass transistor, wherein the bipolar junction transistor has a base coupled to a drain of the second field-effect transistor and a collector coupled to the gate of the pass transistor, and wherein the second current source is coupled between the base of the bipolar junction transistor and an emitter of the bipolar junction transistor.

12. The low drop-out regulator of claim 9 wherein the second current feedback buffer comprises a bias current source, a first input leg including a third field- effect transistor and a current sink, and a second input leg including a fourth field-effect transistor and an auxiliary buffer transistor.

13. The low drop-out regulator of claim 9 wherein the first gate driver circuit comprises a first field-effect transistor having a gate to receive the drive signal, wherein the first current feedback buffer comprises a second field-effect transistor, a first current source, a second current source, and a first bipolar junction transistor, wherein the second field-effect transistor has a gate coupled to a source of the first field-effect transistor, wherein the first current source is coupled to a node formed of the source of the second field-effect transistor and the gate of the pass transistor, wherein the first bipolar junction transistor has a base coupled to a drain of the second field-effect transistor and a collector coupled to the gate of the pass transistor, wherein the second current source is coupled between the base of the first bipolar junction transistor and an emitter of the first bipolar junction transistor, wherein the second current feedback buffer comprises a bias current source, a third field-effect transistor, a current sink, a fourth field-effect transistor, and an auxiliary buffer transistor, wherein the third field-effect transistor has a source coupled to the bias current source, a drain coupled to a first terminal of the current sink, and a gate coupled to the output of the error amplifier, wherein the fourth field-effect transistor has a drain coupled to the bias current source, a source coupled to the gate of the pass transistor, and a gate coupled to the drain of the fourth field-effect transistor, and wherein the auxiliary buffer transistor has a control terminal coupled to the drain of the third field-effect transistor, a first terminal coupled to the source of the fourth field-effect transistor, and a second terminal coupled to a second terminal of the current sink.

14. A low drop-out regulator comprising:

means for providing an output voltage in response to a gate voltage;

means for generating a feedback voltage in response to the output voltage;

means for generating a drive signal in response to the feedback voltage and a reference voltage;

first means for providing the gate voltage in response to the drive signal, the first means for providing the gate voltage being operable over a first voltage range;

second means for providing the gate voltage in response to the drive signal, the second means for providing the gate voltage being operable over a second voltage range, wherein each voltage level in the second voltage range is lower than each voltage level in the first voltage range; and means for steering current to provide bias current to the first means for providing the gate voltage when the output voltage is in the first voltage range and to provide bias current to the second means for providing the gate voltage when the output voltage is in the second voltage range.

15. The low drop-out regulator of claim 14 wherein the first means for providing the gate voltage comprises means for feeding back a current to buffer the gate voltage.

16. The low drop-out regulator of claim 14 wherein the second means for providing the gate voltage comprises means for receiving the drive signal and the gate voltage and differentially buffering the drive signal to produce the gate voltage.

17. The low drop-out regulator of claim 14 wherein the second means for providing the gate voltage comprises means for feeding back a current to buffer the gate voltage.

18. A method comprising: providing an output voltage in response to a gate voltage applied to a gate of a pass transistor; generating a feedback voltage in response to the output voltage; providing the gate voltage from a first gate driver circuit in response to the feedback voltage being in a first voltage range; providing the gate voltage from a second gate driver circuit in response to the feedback voltage being in a second voltage range, wherein each voltage level in the second voltage range is lower than each voltage level in the first voltage range; and steering current to provide bias current to the first gate driver circuit when the output voltage is in the first voltage range and to provide bias current to the second gate driver circuit when the output voltage is in the second voltage range.

19. The method of claim 18 further comprising controlling current to the first gate driver circuit and the second gate driver circuit in response to the feedback voltage.

* * * * *